US012653311B2

(12) United States Patent
Sun et al.

(10) Patent No.: US 12,653,311 B2
(45) Date of Patent: Jun. 16, 2026

(54) CHAIR FRAME AND CASUAL CHAIR

(71) Applicant: HAINING HELI MACHINERY & TECHNOLOGY CO., LTD., Jiaxing (CN)

(72) Inventors: Xiqi Sun, Jiaxing (CN); Qiu Xu, Jiaxing (CN); Mengjie Li, Jiaxing (CN); Junjun Dai, Jiaxing (CN)

(73) Assignee: HAINING HELI MACHINERY & TECHNOLOGY CO., LTD., Jiaxing (CN)

( * ) Notice: Subject to any disclaimer, the term of this patent is extended or adjusted under 35 U.S.C. 154(b) by 133 days.

(21) Appl. No.: 18/663,090

(22) Filed: May 14, 2024

(65) Prior Publication Data

US 2024/0389751 A1 Nov. 28, 2024

(30) Foreign Application Priority Data

May 24, 2023 (CN) ..... 202321285264.7

(51) Int. Cl.
*A47C 1/028* (2006.01)
*A47C 7/50* (2006.01)

(52) U.S. Cl.
CPC ..... *A47C 1/028* (2013.01); *A47C 7/5068* (2018.08)

(58) Field of Classification Search
CPC ..... A47C 1/028; A47C 1/024; A47C 1/0242; A47C 7/5068
USPC ..... 297/325
See application file for complete search history.

(56) References Cited

U.S. PATENT DOCUMENTS

2010/0072805 A1* 3/2010 Qiu ..... A47C 1/0355 74/531
2012/0286557 A1* 11/2012 Hoffman ..... A47C 1/03211 297/85 M
2017/0071344 A1* 3/2017 Marcantoni ..... A47C 1/035
2018/0103761 A1* 4/2018 White ..... A47C 1/0352
2018/0352960 A1* 12/2018 Carrera ..... A47C 1/035
2018/0360217 A1* 12/2018 Fei ..... A61G 5/14
2019/0116978 A1* 4/2019 Jorbel ..... A47C 1/0342
2019/0313796 A1* 10/2019 Lapointe ..... A47C 3/03
2021/0219727 A1* 7/2021 Zhang ..... A47C 3/20
2022/0015543 A1* 1/2022 Bryant ..... A47C 1/0242
2022/0071396 A1* 3/2022 Zhang ..... A61G 5/128
2022/0087431 A1* 3/2022 Zhang ..... A47C 7/5068
2023/0000251 A1* 1/2023 Sha ..... A47C 1/03211
2023/0068014 A1* 3/2023 Sun ..... A47C 1/03211
2024/0032693 A1* 2/2024 Liu ..... A47C 1/0242
2024/0099468 A1* 3/2024 Xiao ..... A47C 7/5068
(Continued)

*Primary Examiner* — Jose V Chen

(57) ABSTRACT

A chair frame and a casual chair are provided. The chair frame includes a frame mechanism, a connecting rod system and a seat mechanism. The connecting rod system includes a basic component fixed to the frame mechanism; a first front arm pivotally connected to the basic component; a first rear arm pivotally connected to the basic component; a first transverse arm pivotally connected to the first front arm and the first rear arm; a second transverse arm pivotally connected to the first front arm; a second rear arm pivotally connected to the first rear arm and the second transverse arm; a second front arm pivotally connected to the second transverse arm; and a lifting component pivotally connected to the second front arm and the second rear arm. The seat mechanism includes a hip-leg supporting component, a front rocker arm and a rear rocker arm.

17 Claims, 9 Drawing Sheets

(56) References Cited

U.S. PATENT DOCUMENTS

| | | | | |
|---|---|---|---|---|
| 2024/0138569 | A1* | 5/2024 | Murphy | A47C 3/0255 |
| 2024/0148144 | A1* | 5/2024 | Li | A47C 1/0345 |
| 2024/0164527 | A1* | 5/2024 | Li | A47C 7/5068 |
| 2024/0292953 | A1* | 9/2024 | Lake | A47C 1/121 |
| 2024/0335042 | A1* | 10/2024 | Liu | A47C 1/024 |
| 2024/0374032 | A1* | 11/2024 | Sun | A47C 1/0355 |
| 2024/0423369 | A1* | 12/2024 | Loccioni | A47C 1/0342 |
| 2025/0072611 | A1* | 3/2025 | Tsay | A47C 1/037 |
| 2025/0185811 | A1* | 6/2025 | Cai | A47C 7/506 |

* cited by examiner

CHAIR FRAME AND CASUAL CHAIR

CROSS-REFERENCE TO RELATED APPLICATION

This application claims priority to Chinese patent application No. 202321285264.7, filed on May 24, 2023, and titled "CHAIR FRAME AND CASUAL CHAIR" the content of which is hereby incorporated by reference in its entirety.

TECHNICAL FIELD

The present disclosure relates to the field of chair, in particular, to a chair frame and a casual chair.

BACKGROUND

A casual chair includes a backrest mechanism and a footrest mechanism, and can be switched to a regular sitting state, a casual state and a lying state according to different user requirements. In the conventional sitting state, the backrest mechanism and a seat mechanism form an L-shape to support human buttocks, while the footrest mechanism remains retracted. In the casual state, the footrest mechanism extends forward with respect to the seat mechanism. In the lying state, the footrest mechanism remains extended, and the backrest mechanism tilts back to increase an angle between the backrest mechanism and the seat mechanism.

However, the casual chairs often fall short in providing a comfortable reclining experience in the lying state. Due to limited footrest elevation in the conventional casual chairs, pressure tends to concentrate near the buttocks, diminishing user comfort. Consequently, a transition from the casual state to the lying state may lack a noticeable improvement in user experience, failing to deliver a distinctly different comfort level between the two states.

SUMMARY

In view of above, it is necessary to provide a chair frame that improves the distribution of pressure on the user and provides a more comfortable and relaxing lying experience for the user when the chair is in the lying state.

The chair frame of the present disclosure includes a frame mechanism, a connecting rod system disposed on the frame mechanism and a seat mechanism disposed on the connecting rod system. The connecting rod system includes a basic component, a first front arm, a first rear arm, a first transverse arm, a second transverse arm, a second rear arm, a second front arm, and a lifting component. The basic component is fixed to the frame mechanism. The first front arm is pivotally connected to a front end of the basic component. The first rear arm is pivotally connected to a rear end of the basic component. The first transverse arm is pivotally connected to the first front arm and the first rear arm. The second transverse arm is pivotally connected to the first front arm. The second rear arm is pivotally connected to the first rear arm and the second transverse arm. The second front arm is pivotally connected to the second transverse arm. The lifting component is pivotally connected to the second front arm and the second rear arm. The seat mechanism includes a hip-leg supporting component suspended relative to the basic component, a front rocker arm pivotally connected to the hip-leg supporting component and the lifting component, and a rear rocker arm pivotally connected to the hip-leg supporting component.

When the chair frame is switched from the casual state to the lying state, the connecting rod system significantly moves and deforms. In the arm rods consisting the connecting rod system, the lifting component significantly moves relative to the frame mechanism. Thus, the lifting component can cause the seat mechanism to move significantly relative to the frame mechanism via the front rocker arm and the rear rocker arm, and cause the seat mechanism to significantly turn up, so that a position and a posture of the seat mechanism can further change on the basis of the casual state.

Comparing to the related art, the chair frame of the present disclosure at least has the following benefits.

When the chair frame is switched from the casual state to the lying state, a noticeable difference in comfort levels between the two states becomes more pronounced. When the chair frame is in the lying state, distribution of pressure from the seat mechanism on the user is improved. An increased higher elevation of a front end of the hip-leg supporting component results in a higher elevation of the footrest mechanism connected to the front end of the hip-leg supporting component. Therefore, the pressure that is originally concentrated on buttocks of the user is shared by both the footrest mechanism and the backrest mechanism. A body of the user further tends to lying when the chair frame is in the lying state, and the user has a more comfortable and relaxing lying experience. At the same time, legs of the user are able to relax, promoting improved blood circulation in the legs.

In some embodiments, the chair frame further includes a driver disposed on the frame mechanism, a footrest mechanism pivotally connected to a front end of the seat mechanism and a transmission component pivotally connected to the footrest mechanism and the rear rocker arm, and the driver is connected to the footrest mechanism and is capable of driving the footrest mechanism.

In some embodiments, the footrest mechanism includes a humerus subassembly, a first radius arm, a second radius arm and a footrest component. The humerus subassembly includes a first humerus arm and a second humerus arm pivotally connected to a front end of the hip-leg supporting component. The first radius arm is pivotally connected to an end of the first humerus arm away from the hip-leg supporting component. The second radius arm is pivotally connected to an end of the second humerus arm away from the hip-leg supporting component and pivotally connected to a position between both ends of the first humerus arm. The footrest component is pivotally connected to the first radius arm and the second radius arm. The transmission component is pivotally connected to an end of the second humerus arm away from the second radius arm, and the hip-leg supporting component is pivotally connected to a position between both ends of the second humerus arm.

In some embodiments, a planar five-connecting-rod mechanism is defined by the basic component, the first rear arm, the second rear arm, the second transverse arm and the first front arm surrounding.

In some embodiments, both ends of the first rear arm are pivotally connected to the first transverse arm and the basic component, respectively. One end of the second rear arm is pivotally connected to a position between both ends of the first rear arm, and the other end of the second rear arm is pivotally connected to a rear end of the lifting component. A rear end of the second transverse arm is pivotally connected to a position between both ends of the second rear arm.

In some embodiments, the first front arm is L-shaped and includes a first rod and a second rod fixed to each other. An end of the first rod away from the second rod is pivotally connected to the basic component, an end of the second rod away from the first rod is pivotally connected to a front end of the second transverse arm, and a front end of the first transverse arm is pivotally connected to a joint of the first rod and the second rod.

In some embodiments, the front end of the second transverse arm is pivotally connected to the first front arm, the rear end of the second transverse arm is pivotally connected to the second rear arm, an upper end of the second front arm is pivotally connected to a middle hinge joint of the second transverse arm, and a distance between the middle hinge joint to the front end of the second transverse arm is smaller than a distance between the middle hinge joint and rear end of the second transverse arm.

In some embodiments, the chair frame further includes a reset spring. One end of the reset spring is connected to the frame mechanism, and the other end of the reset spring is connected to the lifting component. When the chair frame is in a casual state, the reset spring has a shortest length; and when the chair frame is in a lying state, the reset spring is capable of driving the connecting rod system to retract, so as to cause the footrest mechanism to retract.

In some embodiments, a first planar four-rod mechanism is defined by the first front arm, the first rear arm, the first transverse arm and the basic component surrounding, a second planar four-rod mechanism is defined by the second front arm, the second rear arm, the second transverse arm and the lifting component surrounding, and a plane defined by the first planar four-rod mechanism is parallel to a plane defined by the second planar four-rod mechanism.

The present disclosure further provides a casual chair, which includes the chair frame described above.

In the figures, 100 represents a chair frame; 10 represents a frame mechanism; 20 represents a connecting rod system; 21 represents a basic component; 22 represents a first front arm; 221 represents a first rod; 222 represents a second rod; 23 represents a first rear arm; 24 represents a first transverse arm; 25 represents a second front arm; 26 represents a second rear arm; 27 represents a second transverse arm; 271 represents a middle hinge joint; 28 represents a lifting component; 30 represents a seat mechanism; 31 represents a hip-leg supporting component; 32 represents a backrest assembling component; 33 represents a front rocker arm; 34 represents a rear rocker arm; 40 represents a footrest mechanism; 41 represents a first humerus arm; 42 represents a second humerus arm; 421 represents a lifting pivot; 43 represents a first radius arm; 44 represents a second radius arm; 45 represents a footrest component; 51 represents a driver; 52 represents a transmission component; 53 represents a overturning arm; 60 represents a reset spring; and 70 represents a backrest mechanism.

DETAILED DESCRIPTION

The technical solutions in the embodiments of the disclosure will be clearly and completely described hereinafter in conjunction with the accompanying drawings in the embodiments of the disclosure. Obviously, the described embodiments are only a part of the embodiments of the disclosure, and not all of the embodiments. Based on the embodiments in the present disclosure, all other embodiments obtained by a person of ordinary skill in the art without making creative labor fall within the scope of protection of the present disclosure.

Unless otherwise defined, all technical and scientific terms used herein have the same meaning as commonly understood by one of ordinary skill in the art belonging to the present disclosure. Terms used herein in the specification of the disclosure are used only for the purpose of describing specific embodiments and are not intended to limit the disclosure. The term "or/and" as used herein includes any and all combinations of one or more related listed items.

The present disclosure provides a chair frame 100 and a casual chair including the chair frame 100, and the casual chair can be obtained by coating soft materials on the outside of the chair frame 100. In the present disclosure, the chair frame 100 has three states: a sitting state shown in FIG. 1, a casual state shown in FIG. 2, and a lying state shown in FIG. 3.

Figure 1:
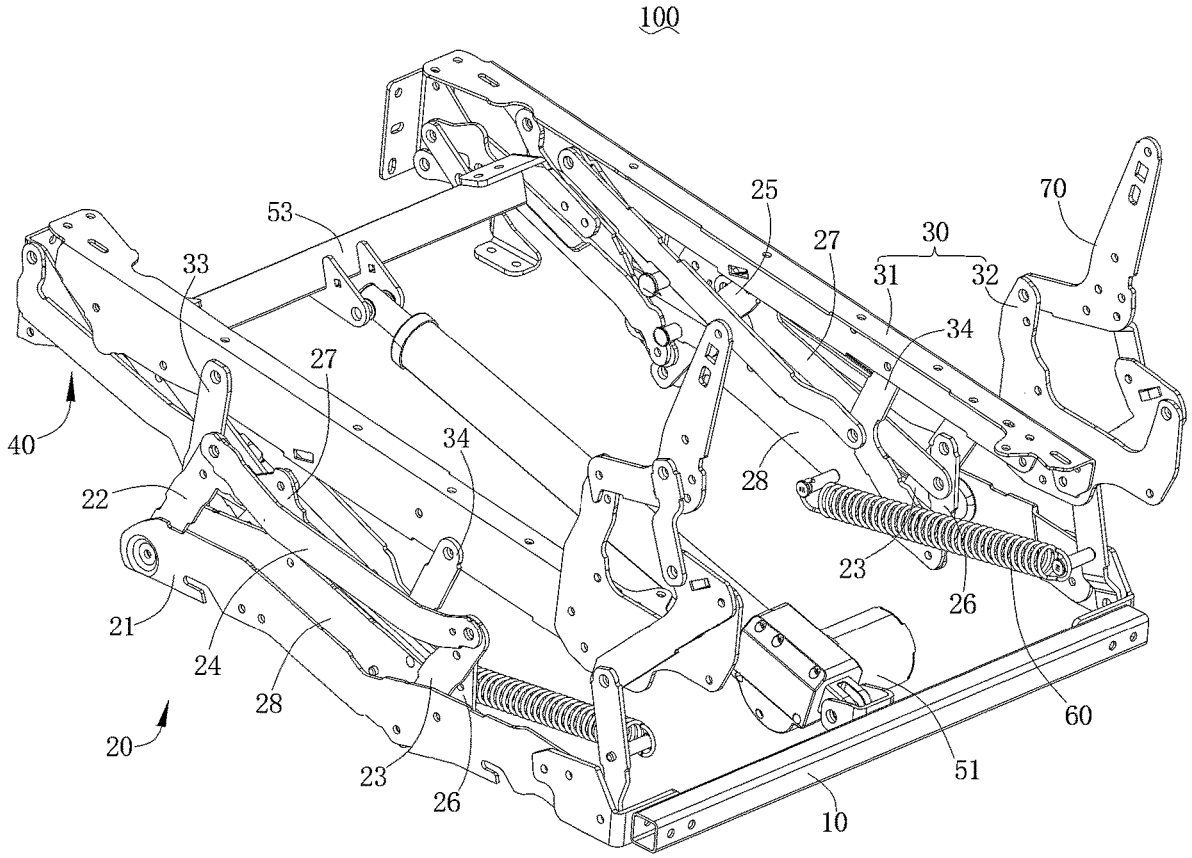
FIG. 1 is a stereo structural schematic diagram of a chair frame in an embodiment of the present disclosure in the sitting state.
Figure 2:
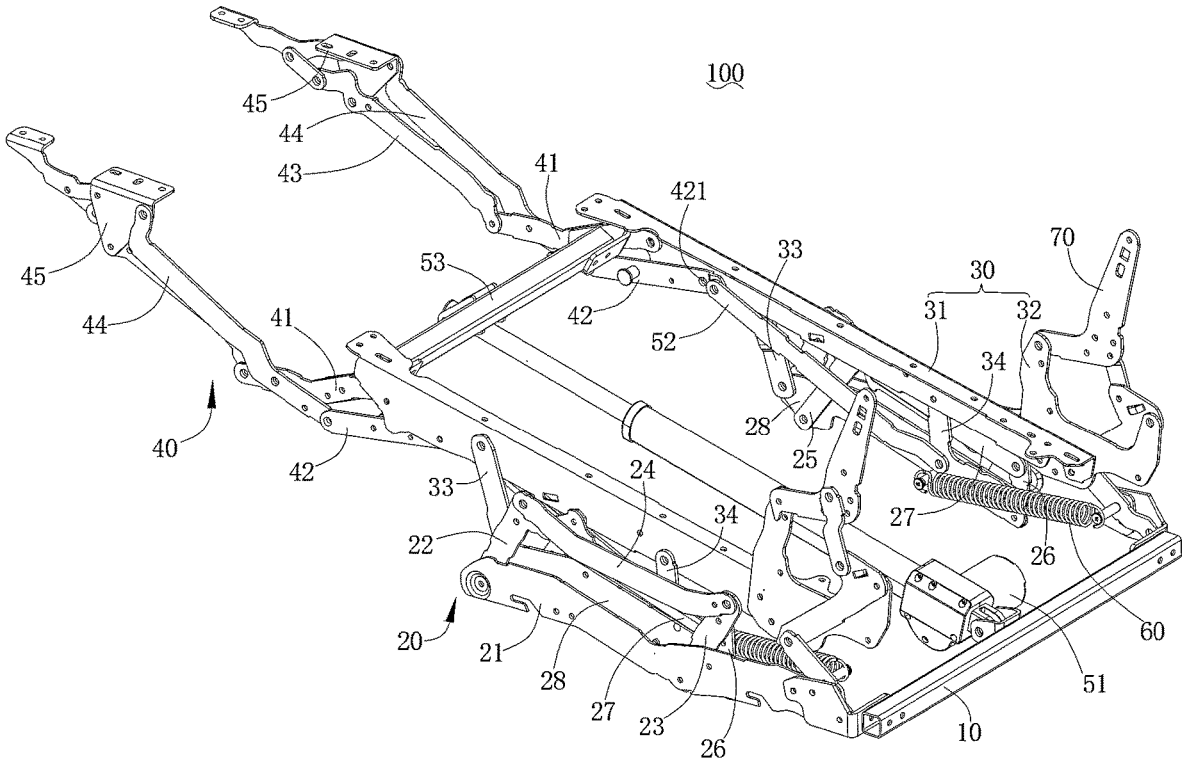
FIG. 2 is a stereo structural schematic diagram of a chair frame in an embodiment of the present disclosure in the casual state.
Figure 3:
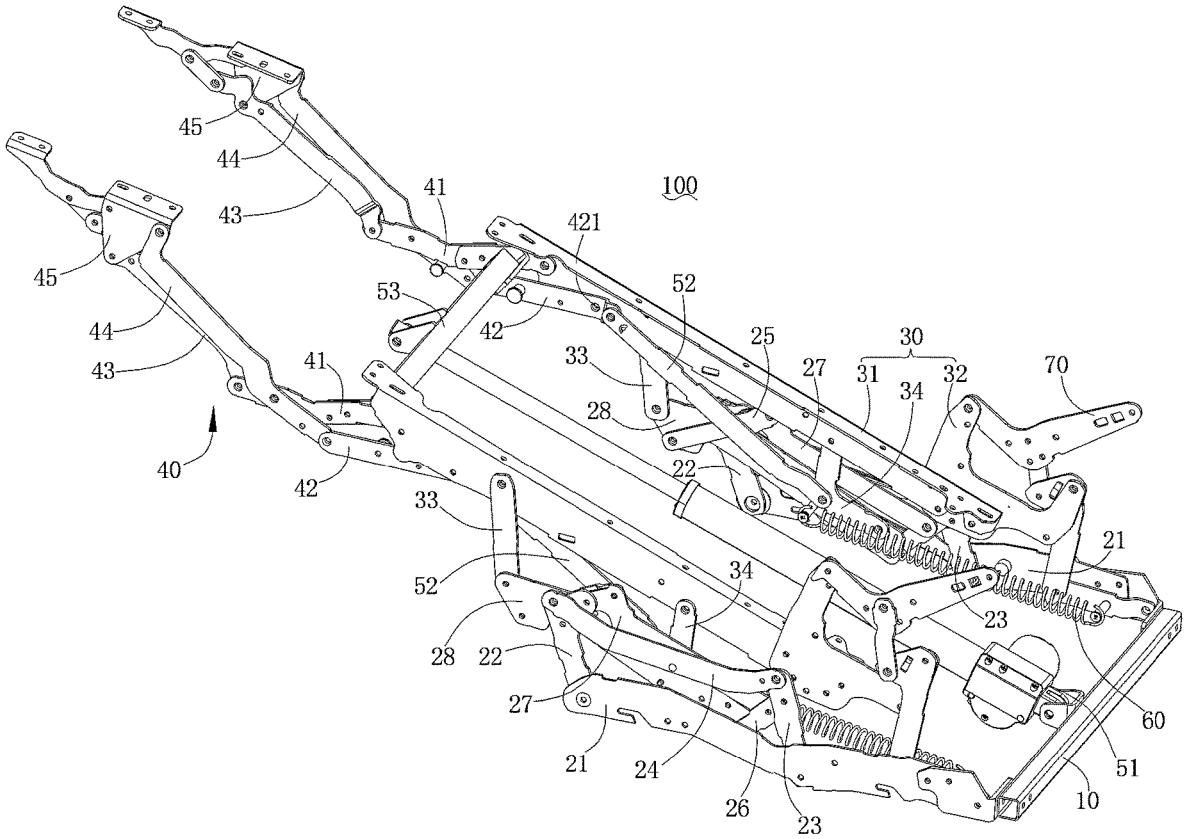
FIG. 3 is a stereo structural schematic diagram of a chair frame in an embodiment of the present disclosure in the lying state.
Figure 4:
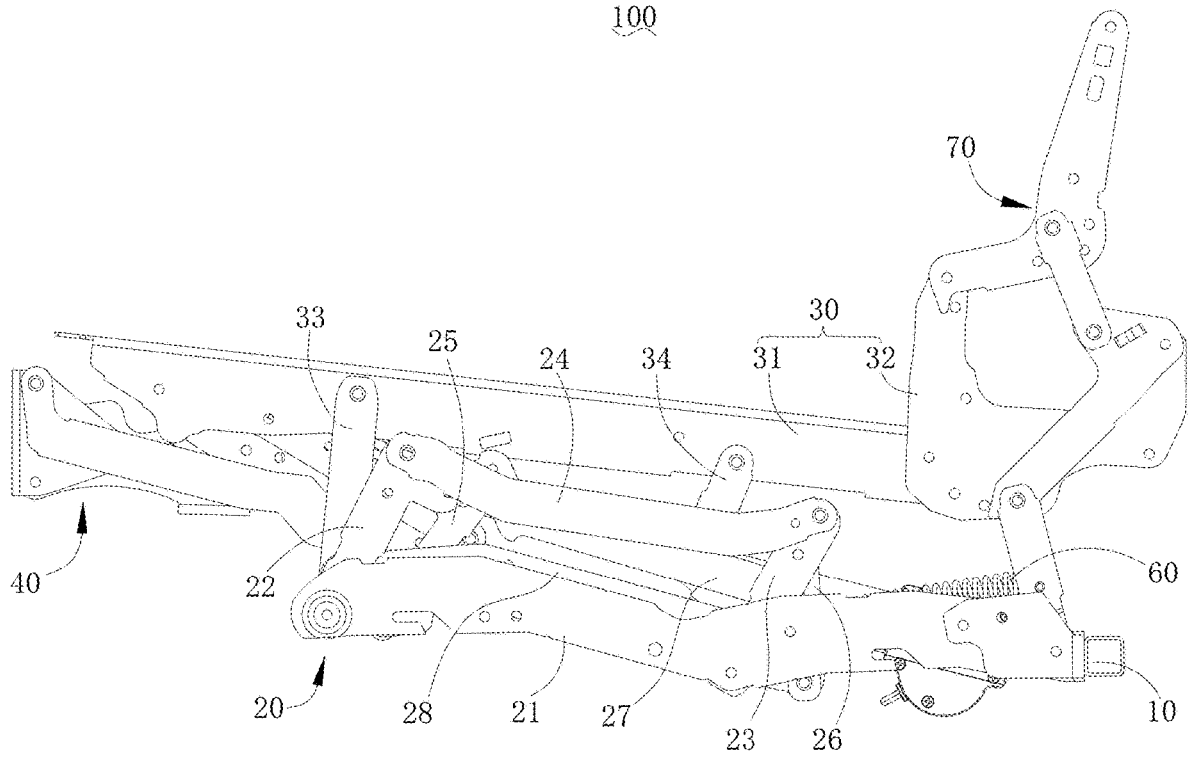
FIG. 4 is a side view of a chair frame in an embodiment of the present disclosure in the sitting state.

Referring to FIG. 1 to FIG. 3, the chair frame 100 includes a frame mechanism 10, a connecting rod system 20 disposed on the frame mechanism 10, a seat mechanism 30 disposed on the connecting rod system 20, a footrest mechanism 40 rotatably connected to a front end of the seat mechanism 30, a backrest mechanism 70 connected to a rear end of the seat mechanism 30 and the frame mechanism 10, and a driver 51 disposed on the frame mechanism 10. In addition, the chair frame 100 further includes a transmission component 52 configured to connect the foot rest mechanism 40 and the connecting rod system 20, and the driver 51 is connected to the footrest mechanism 40 and is capable of driving the footrest mechanism.

Whether the chair frame 100 is in the sitting state, the casual state of the lying state, the frame mechanism 10 is fixed to the ground.

When the chair frame 100 is in the sitting state, the connecting rod system 20 is in a retracted state. When the chair frame 100 is in the casual state, the chair frame is in a pre-stretching state. When the chair frame 100 is in the lying state, the connecting rod system 20 is in an entirely-stretched state. Compared with the connecting rod system 20 in the pre-stretching state, the connecting rod system 20 is further stretched in the entirely-stretched state. The connecting rod system 20 is configured to guide the seat mechanism 30 to move relative to the frame mechanism 10 and change a position and posture of the seat mechanism 30.

The seat mechanism 30 is configured for supporting the buttocks of the user. The footrest mechanism 40 is configured for supporting legs and feet of the user. The backrest mechanism 70 is configured for supporting back, head and neck of the user.

The connecting rod system 20 and the seat mechanism 30 are described herein. Referring to FIG. 4, FIG. 5, FIG. 6 and FIG. 9, the connecting rod system 20 includes a rod-shaped basic component 21. The basic component 21 is fixed to the frame mechanism 10, and extends along a direction from the front to the rear of the chair frame 100. The front of the chair frame 100 is the left side of the FIG. 4, and the front of the chair frame 100 is the right side of the FIG. 4.

The connecting rod system 20 further includes a first front arm 22 pivotally connected to a front end of the basic component 21, a first rear arm 23 pivotally connected to the rear end of the basic component 21, and a first transverse arm 24 pivotally connected to an upper end of the first front arm 22 and an upper end of the first rear arm 23. A first planar four-rod mechanism is defined by the basic component 21, the first front arm 22, the first rear arm 23 and the first transverse arm 24 surrounding.

Specifically, a hinge joint of the lower end of the first front arm 22 and the front end of the basic component 21 is defined as f, a hinge joint of the first front arm 22 and the front end of the first transverse arm 24 is defined as c, a hinge joint of the upper end of the first rear arm 23 and the rear end of the first transverse arm 24 is defined as h and a hinge joint of the lower end of the first rear arm 23 and the basic component 21 is defined as j. A planar quadrangle is defined by the hinge joint f of the lower end of the first front arm 22 and the front end of the basic component 21, the hinge joint c of the first front arm 22 and the front end of the first transverse arm 24, the hinge joint h of the upper end of the first rear arm 23 and the rear end of the first transverse arm 24 and the hinge joint j of the lower end of the first rear arm 23 and the basic component 21. In some embodiments, a parallelogram is defined by the hinge joint f of the lower end of the first front arm 22 and the front end of the basic component 21, the hinge joint c of the first front arm 22 and the front end of the first transverse arm 24, the hinge joint h of the upper end of the first rear arm 23 and the rear end of the first transverse arm 24 and the hinge joint j of the lower end of the first rear arm 23 and the basic component 21.

Figure 5:
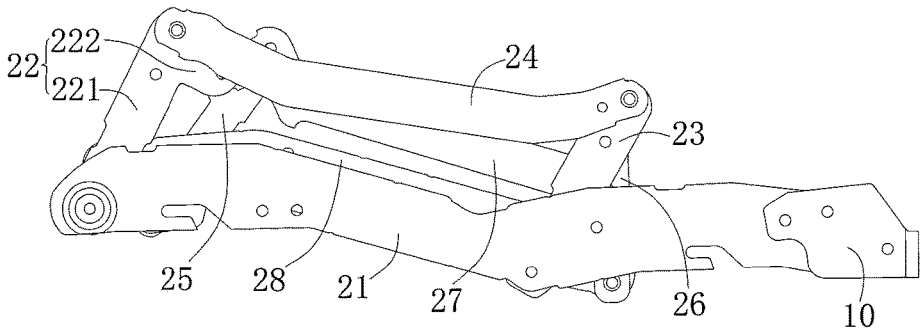
FIG. 5 is a first side view of a connecting rod system in an embodiment of the present disclosure in the sitting state.
Figure 9:
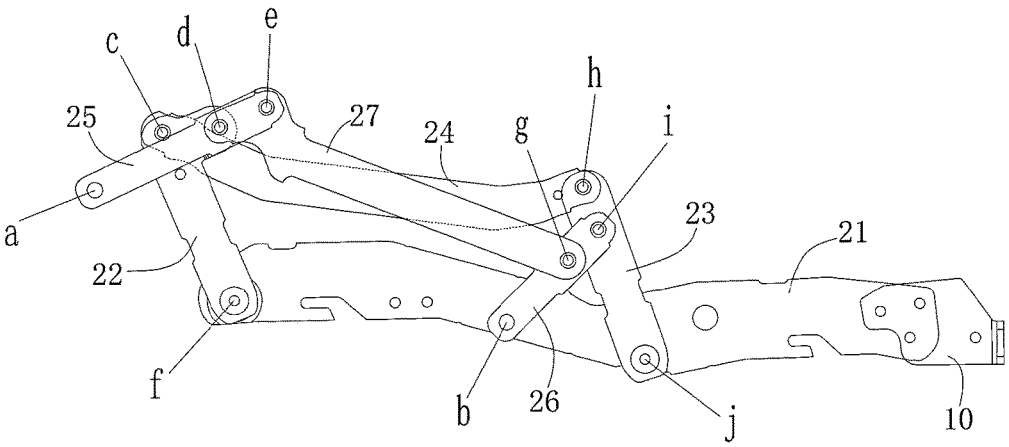
FIG. 9 shows connecting relationships of a connecting rod system in an embodiment of the present disclosure in the lying state.
Figure 10:
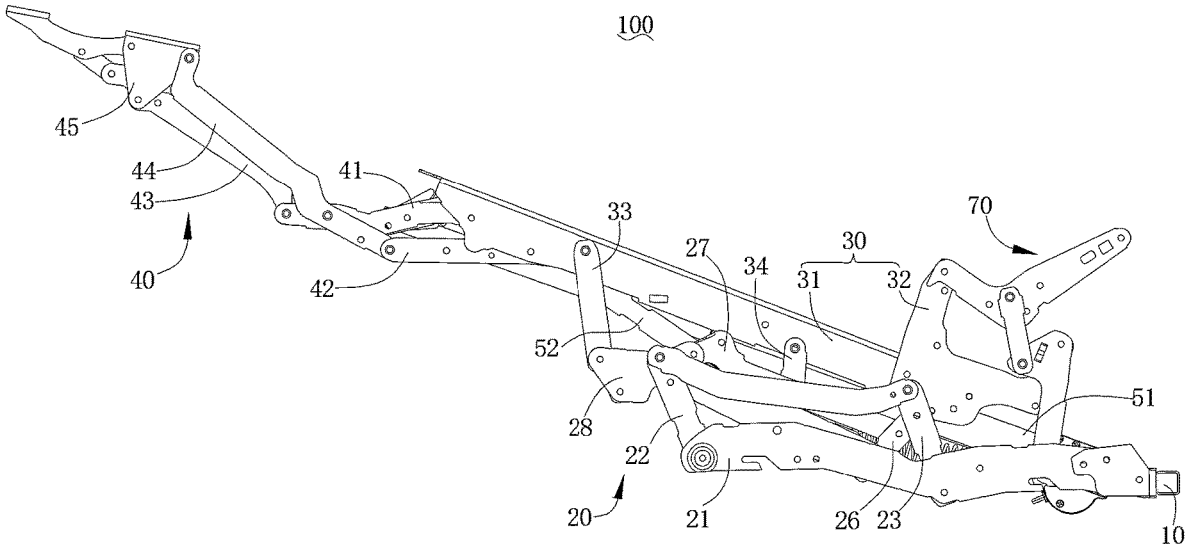
FIG. 10 is a first side view of a chair frame in an embodiment of the present disclosure in the lying state.

Referring to FIG. 5 and FIG. 9, the connecting rod system 20 further includes a second transverse arm 27 pivotally connected to the first front arm 22, a second rear arm 26 pivotally connected to the first rear arm 23 and the second transverse arm 27, a second front arm 25 pivotally connected to the second transverse arm 27, and a lifting component 28 pivotally connected to the second front arm 25 and the second rear arm 26. A second planar four-rod mechanism is defined by the second front arm 25, the second rear arm 26, the second transverse arm 27 and the lifting component 28 surrounding.

In some embodiments, a plane defined by the first planar four-rod mechanism is parallel to a plane defined by the second planar four-rod mechanism.

Specifically, a hinge joint of the lower end of the second front arm 25 and the front end of the lifting component 28 is defined as a, a hinge joint of the upper end of the second front arm 25 and the second transverse arm 27 is defined as e, a hinge joint of the second transverse arm 27 and the second rear arm 26 is defined as g, and a hinge joint of the second rear arm 26 and the lifting component 28 is defined as b. A planar quadrangle is defined by the hinge joint a of the lower end of the second front arm 25 and the front end of the lifting component 28, the hinge joint e of the upper end of the second front arm 25 and the second transverse arm 27, the hinge joint g of the second transverse arm 27 and the second rear arm 26 and the hinge joint b of the second rear arm 26 and the lifting component 28.

In some embodiments, a line defined by the hinge joint a of the lower end of the second front arm 25 and the front end of the lifting component 28 and the hinge joint b of the second rear arm 26 and the lifting component 28 is longer than a line defined by the hinge joint e of the upper end of the second front arm 25 and the second transverse arm 27 and the hinge joint g of the second transverse arm 27 and the second rear arm 26; and a line defined by the hinge joint a of the lower end of the second front arm 25 and the front end of the lifting component 28 and the hinge joint e of the upper end of the second front arm 25 and the second transverse arm 27 is longer than a line defined by the hinge joint g of the second transverse arm 27 and the second rear arm 26 and the hinge joint b of the second rear arm 26 and the lifting component 28.

Referring to FIG. 9, a planer five-connecting-rod mechanism is defined by the basic component 21, the first rear arm 23, the second rear arm 26, the second transverse arm 27 and the first front arm 22 surrounding. That is, a planar pentagon is defined by the hinge joint f of the lower end of the first front arm 22 and the front end of the basic component 21, the hinge joint j of the lower end of the first rear arm 23 and the basic component 21, a hinge joint i of the first arm 23 and the second rear arm 26, the hinge joint g of the second transverse arm 27 and the second rear arm 26 and a hinge joint d of the first front arm 22 and the second transvers arm 27.

Referring to FIG. 2, FIG. 3, FIG. 8, and FIG. 11, the seat mechanism 30 includes a hip-leg supporting component 31 suspended relative to the basic component 21, a backrest assembling component 32 fixed on a rear end of the hip-leg supporting component 31, a front rocker arm 33 pivotally connected to the hip-leg supporting component 31 and the front end of the lifting component 28, and a rear rocker arm 34 pivotally connected to the hip-leg supporting component 31 and the rear end of the lifting component 28. A planar four-rod mechanism is defined by the hip-leg supporting component 31, the front rocker arm 33, the rear rocker arm 34 and the lifting component 28 surrounding.

Specifically, a hinge joint of the lifting component 28 and the front rocker arm 33 is defined as S1, a hinge joint of the lifting component 28 and the rear rocker arm 34 is defined as S2, a hinge joint of the hip-leg supporting component 31 and the front rocker arm 33 is defined as S3, a hinge joint of the hip-leg supporting component 31 and the rear rocker arm 34 is defined as S4. A line defined by the hinge joint S1 of the lifting component 28 and the front rocker arm 33 and the hinge joint S2 of the lifting component 28 and the rear rocker arm 34 is longer than the hinge joint S3 of the hip-leg supporting component 31 and the front rocker arm 33 and the hinge joint S4 of the hip-leg supporting component 31 and the rear rocker arm 34.

Figure 6:
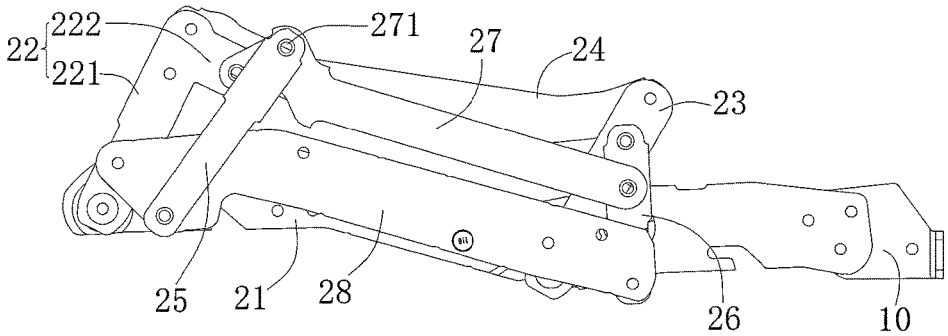
FIG. 6 is a second side view of a connecting rod system in an embodiment of the present disclosure in the sitting state.
Figure 7:
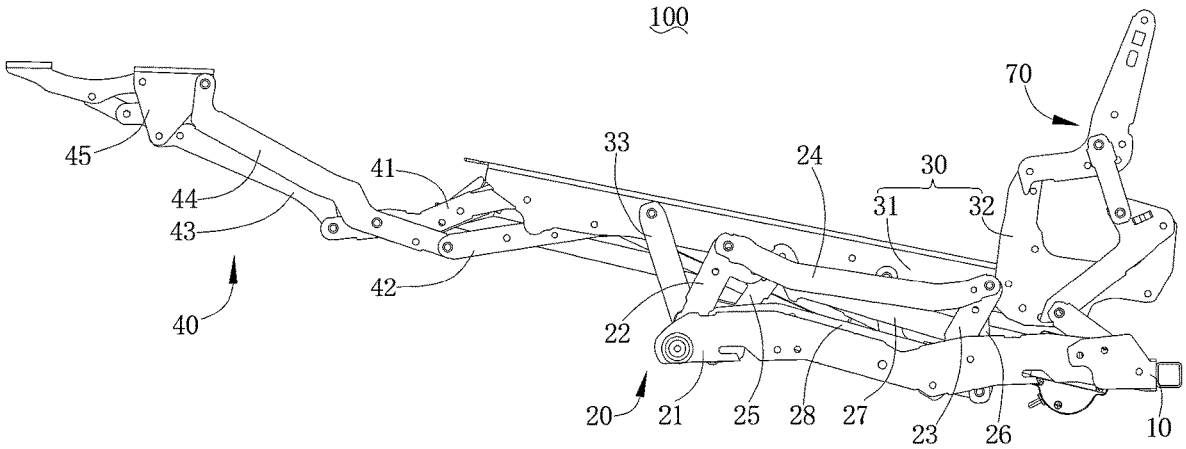
FIG. 7 is a first side view of a chair frame in an embodiment of the present disclosure in the casual state.

Referring to FIG. 5 and FIG. 6, when the chair frame 100 is in the lying state, the first planar four-rod mechanism and the second planar four-rod mechanism are stacked along a direction perpendicular to the first planar four-rod mechanism and the second planar four-rod mechanism. The lifting component 28 nearly overlaps with the basic component 21, first transverse arm 24 is almost parallel with the second transverse arm 27, and the first front arm 22 is almost parallel with the first rear arm 23.

Figure 12:
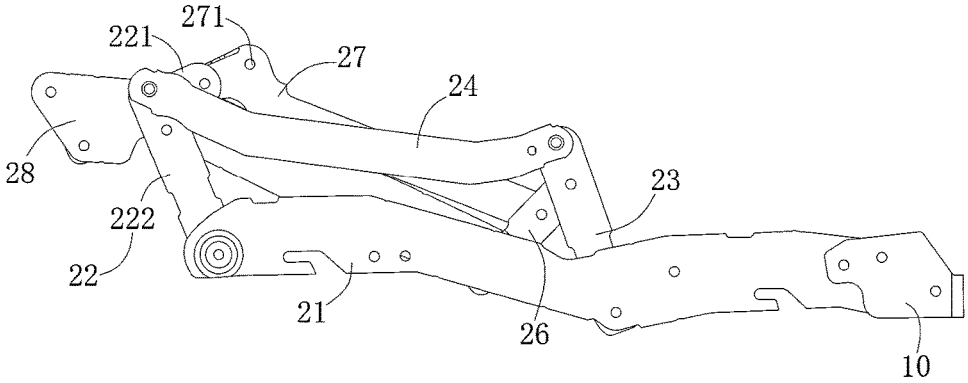
FIG. 12 is a first side view of a connecting rod system in an embodiment of the present disclosure in the lying state.
Figure 13:
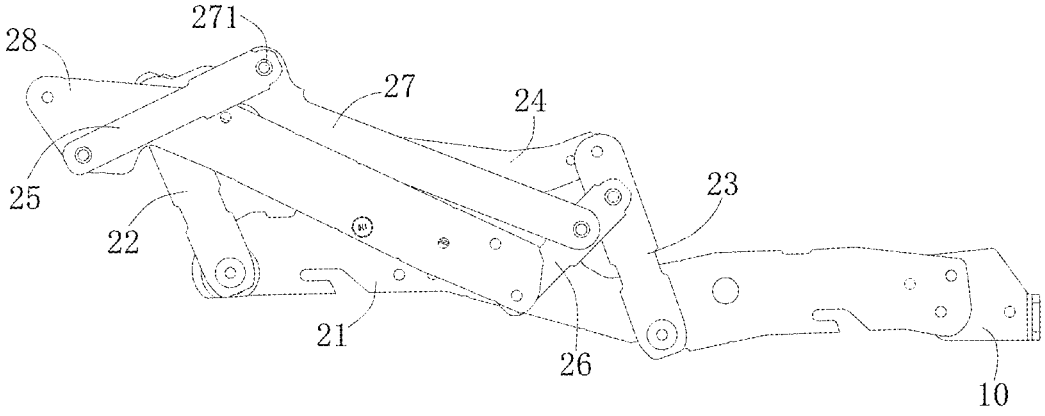
FIG. 13 is a second side view of a connecting rod system in an embodiment of the present disclosure in the lying state.

When the chair frame 100 is switched from the sitting state to the lying state, the first transverse arm 24 moves to the front of the chair frame 100 relative to the frame mechanism 10, the lifting component 28 moves to the front of the chair frame 100 relative to the frame mechanism 10, and the front end of the lifting component 28 significantly raises along the vertical direction. Referring to FIG. 12 and FIG. 13, when the chair frame 100 is in the lying state, the lifting component 28 is almost parallel with the second transverse arm 27, a distance from the lifting component 28 to the ground gradually increases along a direction from the rear end of the lifting component 28 to the front end of the lifting component 28.

Referring to FIG. 1, FIG. 2, FIG. 6, FIG. 13, the upper end of the first rear arm 23 is pivotally connected to the rear end of the first transverse arm 24, and the lower end of the first rear arm 23 is pivotally connected to the basic component 21. One end of the second rear arm 26 is pivotally connected to a position between both ends of the first rear arm 23, and the other end of the second rear arm 26 is pivotally connected to the rear end of the lifting component 28. The rear end of the second transverse arm 27 is pivotally connected to a position between both ends of the second rear arm 26.

Referring to FIG. 5 and FIG. 6, the first front arm 22 is L-shaped, and includes a first rod 221 and a second rod 222 fixed to the first rod 221. The second rod 222 protrudes out from one end of the first rod 221, and the other end of the first rod 221 away from the second rod 222 is pivotally connected to the front end of the basic component 21. The end of the second rod 222 away from the first rod 221 is pivotally connected to the front end of the second transverse arm 27, and the front end of the first transverse arm 24 is pivotally connected to a joint of the first rod 221 and the second rod 222.

Referring to FIG. 5, FIG. 6 and FIG. 9, the front end of the second transverse arm 27 is pivotally connected to the second rod 222 of the first front arm 22, and the rear end of the second transverse arm 27 is pivotally connected to a position between both ends of the second rear arm 26. The upper end of the second front arm is pivotally connected to the middle hinge joint 271 of the second transverse arm 27. The middle hinge joint 271 is the hinge joint e shown in FIG. 9. A distance between the middle hinge joint 271 to the front end of the second transverse arm 27 is smaller than a distance between the middle hinge joint 271 to the rear end of the second transverse arm 27. That is, a line defined by the hinge joint e and the hinge joint d of the first front arm 22 and the second transvers arm 27 is shorter than a line defined by the hinge joint e and the hinge joint g of the second transverse arm 27 and the second rear arm 26.

Referring to FIG. 2, FIG. 3, FIG. 7, FIG. 8, FIG. 10 and FIG. 11, in some embodiments, the driver 51 is an electric push rod pivotally connected to the frame mechanism 10. The driver 51 includes a driver body pivotally connected to the frame mechanism 10 and a stretchable push rod disposed on the driver body. In addition, driver 51 further includes an overturning arm 53. A tail end of the push rod is pivotally connected to the overturning arm 53. The overturning arm 53 is connected to the footrest mechanism 40. The driver 51 is capable of driving the push rod to extend out of or retract into the driver body, so as to cause the footrest mechanism 40, the connecting rod system 20 and the seat mechanism 30 to move.

Specifically, the footrest mechanism 40 includes a humerus subassembly. The humerus subassembly includes a first humerus arm 41 pivotally connected to the front end of the hip-leg supporting component 31 and a second humerus arm 41 pivotally connected to the front end of the hip-leg supporting component 31. In addition, the footrest mechanism 40 further includes a first radius arm 43, a second radius arm 44 and a footrest component 45. The first radius arm 43 is pivotally connected to an end of the first humerus arm 41 away from the hip-leg supporting component 31. The second radius arm 44 is pivotally connected to the end of the second humerus arm 42 away from the hip-leg supporting component 31 and is pivotally connected to a position between both ends of the first humerus arm 41. The end of the first radius arm 43 away from the first humerus arm 41 is pivotally connected to the footrest component 45, and the end of the second radius arm 44 away from the second humerus arm 42 is pivotally connected to the footrest component 45.

Referring to FIG. 2, FIG. 3, FIG. 8 and FIG. 11, the transmission component 52 is a rod component. One end of the transmission component 52 is pivotally connected to the rear rocker arm 34, the other end of the transmission component 52 is pivotally connected to the end of the second humerus arm 42 away from the second radius arm 44. A hinge joint between the second humerus arm 42 and the hip-leg supporting component 31 is a rotation center of the footrest mechanism 40, and the hinge joint is the lifting pivot 421 when the second humerus arm 42 rotates. The lifting pivot 421 is located between both ends of the second humerus arm 42.

Furthermore, the chair frame 100 further includes a reset spring 60. Referring to FIG. 1 to FIG. 3, one end of the reset spring 60 is connected to the frame mechanism 10, the other end of the reset spring 60 is connected to the lifting component 28. When the chair frame 100 is in the casual state, the reset spring 60 has a shortest length. When the chair frame 100 is switched from the casual state to the lying state, the reset spring 60 deforms and elongates, so that the reset spring 60 accumulates potential energy that is capable of causing the connecting rod system 20 to retract. The potential energy make the connecting rod system 20 have a tendency to retract showing in FIG. 5 and FIG. 6, and make the footrest mechanism 40 have a tendency to retract.

Referring to FIG. 2 and FIG. 3, the overturning arm 53 is fixed to the first humerus arm 41. The driver 51 is capable of driving the push rod to extend out of or retract into the driver body to change the state of the chair frame 100. When the chair frame 100 is in the sitting state, the push rod extends out of the driver body, so as to cause the seat mechanism 30 to move towards the front of the chair frame 100 relative to the frame mechanism 10. At the same time, the overturning arm 53 is driven to make the footrest mechanism 40 to be switched from the retracted state to the extended state. In the process, the footrest mechanism 40 can cause the connecting rod system 20 to gradually extend from the retracted state via the transmission component 52.

When the chair frame 100 is switched to the casual state as shown in FIG. 2, the driver 51 continuously drive the push rod to extend out of the driver body, and the footrest mechanism 40 is kept in the extended state and fixed relative to the seat mechanism 30. At the same time, all of the power output from the driver 51 is configured to drive the seat mechanism 30, the connecting rod mechanism and the backrest mechanism 70. The seat mechanism 30 is pushed forward. The transmission component 52 transfers a part of the power to the connecting rod system 20, so as to make the connecting rod system 20 to continue to extend. The backrest mechanism 70 moves along with the seat mechanism 30 as the seat mechanism 30 moves forward.

Figure 8:
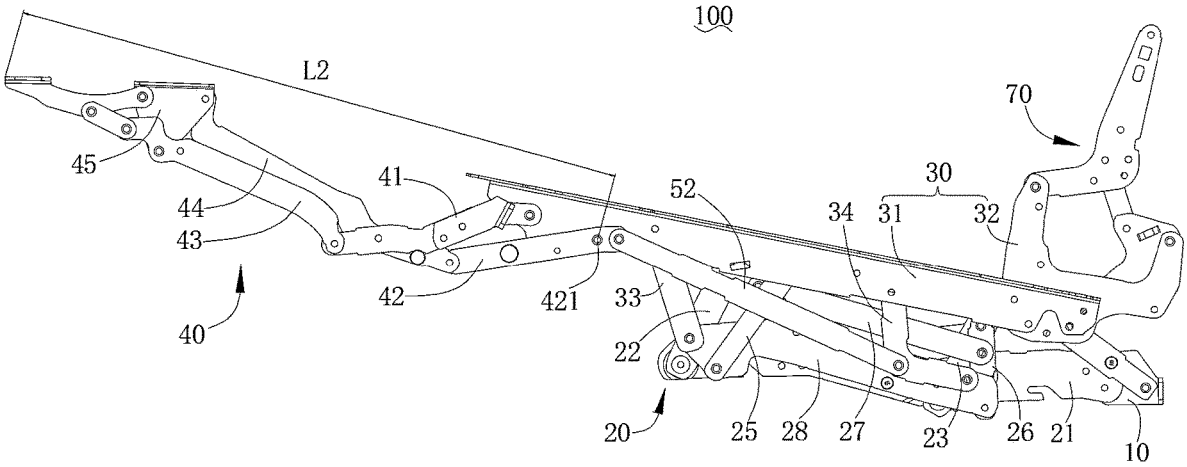
FIG. 8 is a second side view of a chair frame in an embodiment of the present disclosure in the casual state.
Figure 11:
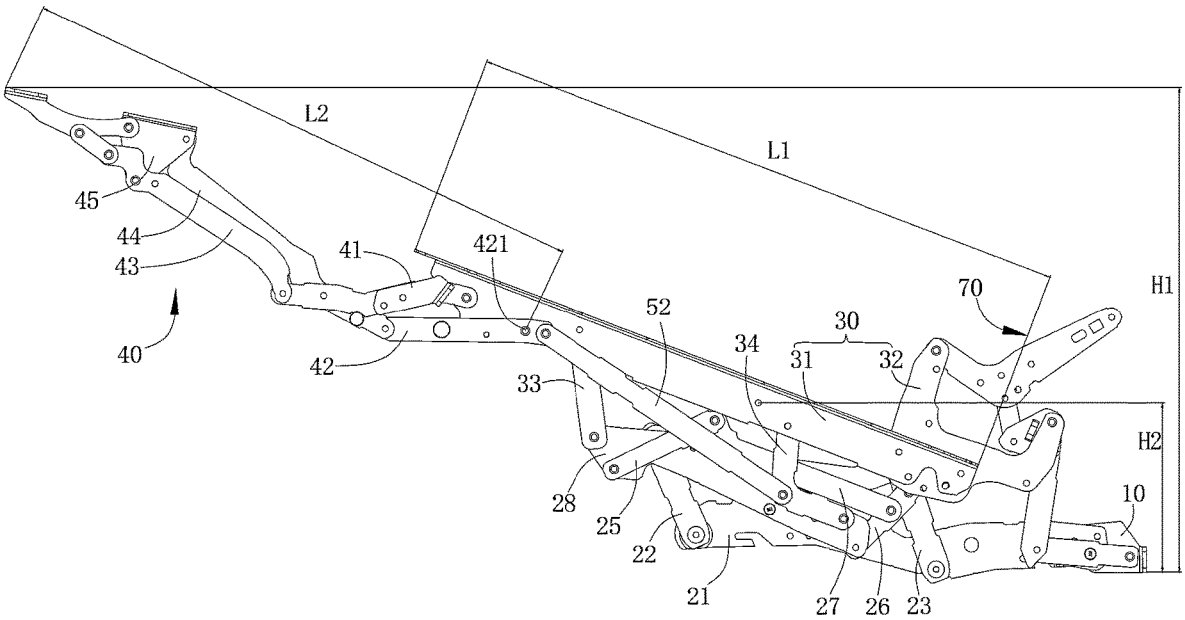
FIG. 11 is a second side view of a chair frame in an embodiment of the present disclosure in the lying state.

Taking the chair frame 100 in FIG. 1 to FIG. 3 as an example, the hip-leg supporting component 31 of the chair frame 100 has a length of 486 mm. Referring to FIG. 8 and FIG. 11, the length of the hip-leg supporting component 31 is L1 shown in FIG. 11. When the chair frame 100 is switched from the casual state to the lying state, a position and posture of the footrest mechanism 40 relative to the seat mechanism 30 is kept. A linear distance from the front end of the footrest component 45 to the lifting pivot 421 is defined as L2. When the chair frame 100 is in the casual state and the lying state, L2 is 462 mm.

It should be noted that the footrest mechanism 40 and the seat mechanism 30 are not improved or adjusted in the present disclosure. Sizes and connection types of the components in the footrest mechanism and the structure and the size of the seat mechanism 30 are the same with the congeneric chair products in the market.

When the chair frame 100 is in the lying state, a height difference between the front end of the footrest component 45 and the bottom of the frame mechanism 10 along the vertical direction is defined as H1 as shown in FIG. 11, and H1 is 390 mm. It could be concluded that the front end of the seat mechanism 30 turns up by a large margin relative to the rear end of the seat mechanism 30. A height difference between a force bearing point of the hip-leg supporting component 31 to the bottom of the frame mechanism 10 along the vertical direction is defined as H2 as shown in FIG. 11, and H2 is 135 mm. A force application point of human buttocks on the hip-leg supporting component 31 is equivalent to the force bearing point of the hip-leg supporting component 31. As a contrast, when the casual chair in related art is in the lying state, a height difference between the front end of the footrest component 45 and the bottom of the frame mechanism 10 in the vertical direction is in a range of 240 mm to 270 mm.

The various technical features of the above-described embodiments may be combined arbitrarily, and all possible combinations of the various technical features of the above-described embodiments have not been described for the sake of brevity of description. However, as long as there is no contradiction in the combination of these technical features, they should be considered to be within the scope of this specification.

Those of ordinary skill in the art should realize that the above embodiments are only used to illustrate the present disclosure, and are not intended to be used as a limitation of the present disclosure. As long as within the scope of the spirit of the disclosure, appropriate changes and variations to the above embodiments fall within the scope of the protection claimed by the disclosure.

What is claimed is:

1. A chair frame, comprising a frame mechanism, a connecting rod system disposed on the frame mechanism and a seat mechanism disposed on the connecting rod system, wherein the connecting rod system comprises a basic component fixed to the frame mechanism;

a first front arm pivotally connected to a front end of the basic component;

a first rear arm pivotally connected to a rear end of the basic component;

a first transverse arm pivotally connected to the first front arm and the first rear arm;

a second transverse arm pivotally connected to the first front arm;

a second rear arm pivotally connected to the first rear arm and the second transverse arm;

a second front arm pivotally connected to the second transverse arm; and a lifting component pivotally connected to the second front arm and the second rear arm, and the seat mechanism comprising a hip-leg supporting component, a front rocker arm and a rear rocker arm, wherein the hip-leg supporting component is suspended over the basic component, the front rocker arm is pivotally connected to the hip-leg supporting component and the lifting component, and the rear rocker arm is pivotally connected to the hip-leg supporting component and the lifting component, wherein a first planar four-rod mechanism is defined by the first front arm, the first rear arm, the first transverse arm and the basic component surrounding, a second planar four-rod mechanism is defined by the second front arm, the second rear arm, the second transverse arm and the lifting component surrounding, and a plane defined by the first planar four-rod mechanism is parallel to a plane defined by the second planar four-rod mechanism.

2. The chair frame of claim 1, wherein the chair frame further comprises a driver disposed on the frame mechanism, a footrest mechanism pivotally connected to a front end of the seat mechanism and a transmission component pivotally connected to the footrest mechanism and the rear rocker arm, and the driver is connected to the footrest mechanism and is capable of driving the footrest mechanism.

3. The chair frame of claim 2, wherein the footrest mechanism comprises a humerus subassembly comprising a first humerus arm and a second humerus arm pivotally connected to a front end of the hip-leg supporting component;

a first radius arm pivotally connected to an end of the first humerus arm away from the hip-leg supporting component;

a second radius arm pivotally connected to an end of the second humerus arm away from the hip-leg supporting component and pivotally connected to a middle part of the first humerus arm; and a footrest component pivotally connected to the first radius arm and the second radius arm, wherein the transmission component is pivotally connected to an end of the second humerus arm away from the second radius arm, and the hip-leg supporting component is pivotally connected to a middle part of the second humerus arm.

4. The chair frame of claim 2, wherein the chair frame further comprises a reset spring, one end of the reset spring is connected to the frame mechanism, and the other end of the reset spring is connected to the lifting component, and when the chair frame is in a casual state, the reset spring has a shortest length; and when the chair frame is in a lying state, the reset spring is capable of driving the connecting rod system to retract, so as to cause the footrest mechanism to retract.

5. The chair frame of claim 1, wherein a planar five-connecting-rod mechanism is defined by the basic component, the first rear arm, the second rear arm, the second transverse arm and the first front arm surrounding.

6. The chair frame of claim 5, wherein both ends of the first rear arm are pivotally connected to the first transverse arm and the basic component, respectively, one end of the second rear arm is pivotally connected to a middle part of the first rear arm, the other end of the second rear arm is pivotally connected to a rear end of the lifting component, and a rear end of the second transverse arm is pivotally connected to a middle part of the second rear arm.

7. The chair frame of claim 1, wherein the first front arm is L-shaped and comprises a first rod and a second rod fixed to each other, an end of the first rod away from the second rod is pivotally connected to the basic component, an end of the second rod away from the first rod is pivotally connected to a front end of the second transverse arm, and a front end of the first transverse arm is pivotally connected to a joint of the first rod and the second rod.

8. The chair frame of claim 1, wherein the front end of the second transverse arm is pivotally connected to the first front arm, a rear end of the second transverse arm is pivotally connected to the second rear arm, an upper end of the second front arm is pivotally connected to a middle hinge joint of the second transverse arm, and a distance between the middle hinge joint to the front end of the second transverse arm is smaller than a distance between the middle hinge joint and the rear end of the second transverse arm.

9. A casual chair, comprising the chair frame of claim 1.

10. The casual chair of claim 9, wherein the chair frame further comprises a driver disposed on the frame mechanism, a footrest mechanism pivotally connected to a front end of the seat mechanism and a transmission component pivotally connected to the footrest mechanism and the rear rocker arm, and the driver is connected to the footrest mechanism and is capable of driving the footrest mechanism.

11. The chair frame of claim 10, wherein the footrest mechanism comprises a humerus subassembly comprising a first humerus arm and a second humerus arm pivotally connected to a front end of the hip-leg supporting component;

a first radius arm pivotally connected to an end of the first humerus arm away from the hip-leg supporting component;

a second radius arm pivotally connected to an end of the second humerus arm away from the hip-leg supporting component and pivotally connected to a middle part of the first humerus arm; and a footrest component pivotally connected to the first radius arm and the second radius arm, wherein the transmission component is pivotally connected to an end of the second humerus arm away from the second radius arm, and the hip-leg supporting component is pivotally connected to a middle part of the second humerus arm.

12. The chair frame of claim 10, wherein the chair frame further comprises a reset spring, one end of the reset spring is connected to the frame mechanism, and the other end of the reset spring is connected to the lifting component, and when the chair frame is in a casual state, the reset spring has a shortest length; and when the chair frame is in a lying state, the reset spring is capable of driving the connecting rod system to retract, so as to cause the footrest mechanism to retract.

13. The chair frame of claim 9, wherein a planar five-connecting-rod mechanism is defined by the basic component, the first rear arm, the second rear arm, the second transverse arm and the first front arm surrounding.

14. The chair frame of claim 13, wherein both ends of the first rear arm are pivotally connected to the first transverse arm and the basic component, respectively, one end of the second rear arm is pivotally connected to a middle part of the first rear arm, the other end of the second rear arm is pivotally connected to a rear end of the lifting component, and a rear end of the second transverse arm is pivotally connected to a middle part of the second rear arm.

15. The chair frame of claim 9, wherein the first front arm is L-shaped and comprises a first rod and a second rod fixed to each other, an end of the first rod away from the second rod is pivotally connected to the basic component, an end of the second rod away from the first rod is pivotally connected to a front end of the second transverse arm, and a front end of the first transverse arm is pivotally connected to a joint of the first rod and the second rod.

16. The chair frame of claim 9, wherein the front end of the second transverse arm is pivotally connected to the first front arm, a rear end of the second transverse arm is pivotally connected to the second rear arm, an upper end of the second front arm is pivotally connected to a middle hinge joint of the second transverse arm, and a distance between the middle hinge joint to the front end of the second transverse arm is smaller than a distance between the middle hinge joint and the rear end of the second transverse arm.

17. The chair frame of claim 9, wherein a first planar four-rod mechanism is defined by the first front arm, the first rear arm, the first transverse arm and the basic component surrounding, a second planar four-rod mechanism is defined by the second front arm, the second rear arm, the second transverse arm and the lifting component surrounding, and a plane defined by the first planar four-rod mechanism is parallel to a plane defined by the second planar four-rod mechanism.

* * * * *